US010907878B2

(12) United States Patent
Fryer-Biggs et al.

(10) Patent No.: US 10,907,878 B2
(45) Date of Patent: Feb. 2, 2021

(54) ELECTRICITY FREE PORTABLE EVAPORATIVE COOLING DEVICE

(71) Applicant: Evaptainers, LLC, Somerville, MA (US)

(72) Inventors: Jeremy Fryer-Biggs, Somerville, MA (US); Quang Truong, Somerville, MA (US); Spencer Taylor, Somerville, MA (US); Josh Guyot, Somerville, MA (US)

(73) Assignee: Evaptainers, LLC, Somerville, MA (US)

( * ) Notice: Subject to any disclaimer, the term of this patent is extended or adjusted under 35 U.S.C. 154(b) by 56 days.

(21) Appl. No.: 16/331,428

(22) PCT Filed: Sep. 22, 2017

(86) PCT No.: PCT/US2017/053072

§ 371 (c)(1),
(2) Date: Mar. 7, 2019

(87) PCT Pub. No.: WO2018/057966

PCT Pub. Date: Mar. 29, 2018

(65) Prior Publication Data

US 2019/0219321 A1 Jul. 18, 2019

Related U.S. Application Data

(60) Provisional application No. 62/398,989, filed on Sep. 23, 2016.

(51) Int. Cl.
*F25D 7/00* (2006.01)
*F25D 3/00* (2006.01)
(Continued)

(52) U.S. Cl.
CPC ..... *F25D 7/00* (2013.01); *F24F 5/0035* (2013.01); *F24F 6/04* (2013.01); *F24F 13/20* (2013.01);
(Continued)

(58) Field of Classification Search
CPC ..... F25D 7/00; F25D 3/00; F25D 3/10; F25D 2303/0843; F25D 2400/12;
(Continued)

(56) References Cited

U.S. PATENT DOCUMENTS 3,279,208 A * 10/1966 Butler ..... F25D 7/00 62/316
3,385,078 A * 5/1968 Teters ..... F25D 7/00 62/316
(Continued)

FOREIGN PATENT DOCUMENTS

CN 1914469 A 2/2007
CN 1934403 A 3/2007
(Continued)

OTHER PUBLICATIONS

Int'l App. No. PCT/US2017/053072, Notification of Transmittal of the International Search Report and Written Opinion of the International Searching Authority, ISA/US, dated Dec. 20, 2017, 7 pgs.

*Primary Examiner* — Emmanuel E Duke
(74) *Attorney, Agent, or Firm* — Holland & Hart LLP

(57) ABSTRACT

An evaporative cooling device including a combination of insulative surfaces and evaporative surfaces that may hold and cool contents with walls that are made of semipermeable materials. The evaporative surfaces store and facilitate the evaporation of a liquid to cool the interior of the evaporative cooling device while the insulative surfaces limit heat transfer in or out of the evaporative cooling device from air, sunlight or the ground. The evaporative cooling device is
(Continued)

further capable of holding a variety of products at a temperature below ambient environmental temperature, assuming less than 100% humidity. Moreover, the evaporative cooling device may be designed to be lightweight and collapsible for easy transport and storage.

10 Claims, 9 Drawing Sheets

(51) Int. Cl.
*F24F 5/00* (2006.01)
*F24F 6/04* (2006.01)
*F24F 13/20* (2006.01)

(52) U.S. Cl.
CPC ..... *F25D 3/00* (2013.01); *F25D 2303/0843* (2013.01); *F25D 2323/061* (2013.01); *F25D 2331/804* (2013.01); *F25D 2331/809* (2013.01); *F25D 2400/12* (2013.01)

(58) Field of Classification Search
CPC ..... F25D 2323/061; F25D 2331/804; F25D 2331/809; F24F 5/0035; F24F 6/04; F24F 13/20
See application file for complete search history.

(56) References Cited

U.S. PATENT DOCUMENTS

| | | | | |
|---|---|---|---|---|
| 4,038,836 | A * | 8/1977 | Rose | F25D 7/00 62/316 |
| 2006/0182372 | A1 | 8/2006 | Fadal, II et al. | |
| 2006/0248910 | A1 | 11/2006 | Smolko et al. | |
| 2007/0157653 | A1 | 7/2007 | Sasaki et al. | |
| 2011/0272419 | A1 | 11/2011 | Vanderberg et al. | |
| 2014/0223953 | A1 | 8/2014 | Kalwick | |

FOREIGN PATENT DOCUMENTS

| | | | |
|---|---|---|---|
| CN | 201378004 | Y | 1/2010 |
| CN | 109804211 | A | 5/2019 |
| WO | WO-2018057966 | A1 | 3/2018 |

* cited by examiner

ELECTRICITY FREE PORTABLE EVAPORATIVE COOLING DEVICE

CROSS REFERENCES

The present application is a 371 national phase filing on International Application No. PCT/US 017/053072 to Fryer-Biggs et al., entitled "ELECTRICITY FREE PORTABLE EVAPORATIVE COOLING DEVICE", filed Sep. 22, 2017, and to Provisional Patent Application No. 62/398,989 by Fryer-Biggs et al., entitled "ELECTRICITY FREE PORTABLE EVAPORATIVE COOLING DEVICE," filed Sep. 23, 2016 each of which is assigned to the assignee hereof.

FIELD

The present disclosure relates generally to a cooling device and more particularly to a portable, evaporative cooling device that does not utilize electricity.

BACKGROUND

Various substances, such as medicines, electronics, fresh produce, dairy products, and other such perishables, require lower than ambient temperatures for optimal storage. While traditional compression refrigerators can be used to cool these substances, they cannot operate without a reliable source of electricity. Thus, maintaining lower than the ambient temperatures required for optimal storage is a challenge in areas without an electrical grid, particularly rural areas, nature settings, or throughout much of the developing world.

Numerous devices have been invented in the last century that provide cooling without requiring an electrical grid. For example, ice chests or coolers, such as the ones made by companies like Igloo™ and Yeti™ allow consumers to store perishables inside an insulated container filled with ice. The cold temperature of the ice cools the contents stored within the container, and the thermal insulation protects the ice and the contents from outside heat. Unfortunately, without a source of ice (something which usually requires an electrical grid to create), an ice chest is rendered inoperable in its primary function.

Solid-state refrigerators have also been used in off-grid settings. These devices, also called thereto-electric coolers, use the Peltier effect to transfer heat in a single direction by passing a direct current through the junction of two different metals. While these devices do not require as much total electricity as a full size vapor compression refrigerator, they still require electricity (usually provided by a car battery) to operate. Furthermore, Peltier cooling is 400% less effective at reducing the temperature of a chamber than conventional refrigeration, making them substantially energy inefficient.

Lastly, evaporative coolers such as Zeer pots and Coolgardie safes have been in use for over a century as a means of keeping food cool while off grid. In principle, all evaporative coolers operate the same way: a storage area is surrounded on some or all sides by a material saturated with water. When the water evaporates, heat energy is transferred from the storage area to the external environment to facilitate the vaporization of the water. While Zeer pots and Coolgardie safes have been useful in maintaining cool temperatures, they are generally awkward to use and difficult to transport. For instance, both devices have been known to leak water throughout the day, which is undesirable in the home. In addition, Zeer pots are generally constructed out of sand and ceramic, which are incredibly heavy and fragile.

SUMMARY

The instant series of system, method, and series of apparatuses, as illustrated herein, are clearly not anticipated, rendered obvious, or even present in any of the prior art mechanisms, either alone or in any combination thereof. The instant versatile systems, methods, and series of devices introduce manners of cooling. Thus, the several embodiments of the instant system are illustrated herein.

In one aspect, an evaporative cooling device is introduced that comprises a combination of an insulative surface and an evaporative surface. In another aspect an evaporative cooling device may be capable of holding contents with walls made of semipermeable membranes that cool. In another aspect an evaporative cooling device may be used to hold produce, medications, packaged food or beverages at a temperature below ambient environmental temperature assuming less than 100% humidity. In another aspect, an evaporative cooling device may be used to humidify its contents.

In an additional aspect, evaporative surfaces of the an evaporative cooling device may, facilitate the evaporation of a liquid such as water or alcohol and create cooling in the evaporative cooling device while the insulative surfaces limit heat transfer in or out of the evaporative cooling device from air, sunlight or the ground.

In an embodiment, the evaporative cooling device comprises an insulative top portion and bottom portion and a series of walls. The evaporative cooling device may include at least one evaporative surface or evaporative wall. In an additional embodiment, the evaporative cooling device may be designed to encompass many evaporative surfaces and may include embodiments in which up to all sides of the evaporative cooling device may be evaporative. Yet another embodiment, the evaporative cooling device may comprise a shape with more or less than six sides. Further, in yet another embodiment, the evaporative cooling device may comprise partially evaporative substance panels.

Realizing one aspect of the apparatus is an evaporative cooling device capable of holding a variety of products at a temperature below the ambient environmental temperature, assuming less than 100% humidity, wherein the evaporative cooling device comprises a combination of an insulative surface and an evaporative surface.

These together with other objects of the system and apparatus, along with the various features of novelty, which characterize the system and apparatus, are pointed out with particularity in the claims annexed to and forming a part of this disclosure. For a better understanding of the system, its operating advantages and the specific objects attained by its uses, reference should be made to the accompanying drawings and descriptive matter in which there are illustrated several embodiments of the system.

To the accomplishment of the foregoing and related ends, certain illustrative aspects are described herein in connection with the following description and the annexed drawings. These aspects are indicative of the various ways in which the principles disclosed herein can be practiced and all aspects and equivalents thereof are intended to be within the scope of the claimed subject matter. Other advantages and novel features will become apparent from the following detailed description when considered in conjunction with the drawings.

BRIEF DESCRIPTION OF THE DRAWINGS

FIG. 1 illustrates an outside perspective view of one embodiment of an evaporative cooling device with the top cover portion on;

DETAILED DESCRIPTION OF THE SEVERAL EMBODIMENTS

Figure 1:
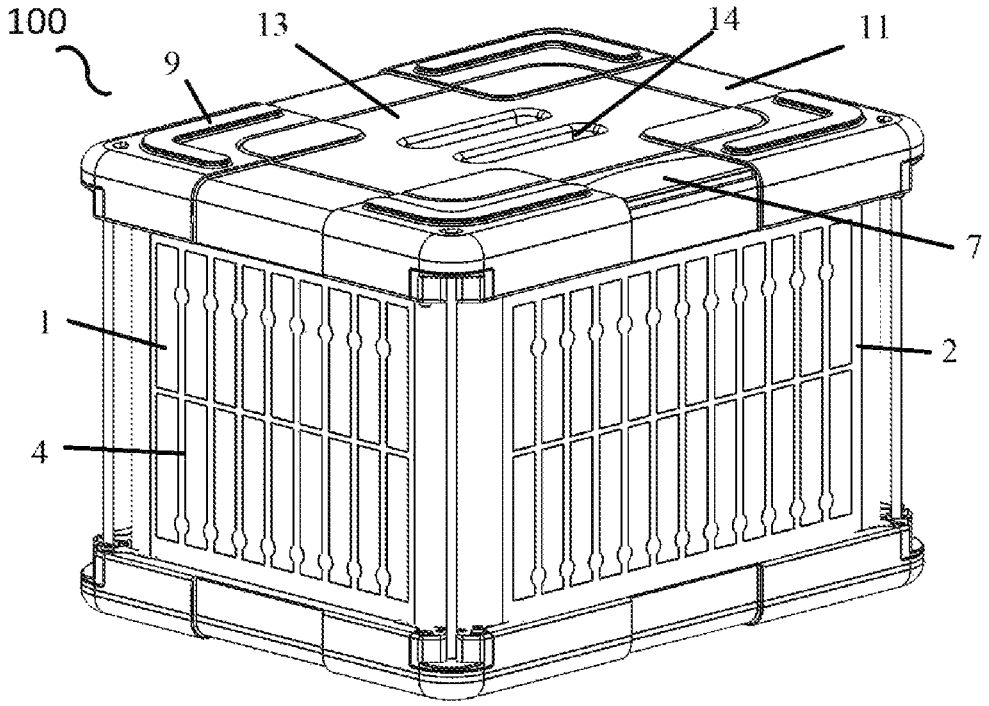

The detailed description set forth below in connection with the appended drawings is intended as a description of examples of an evaporative cooling device and does not represent the only forms in which the evaporative cooling device may be constructed and/or utilized. The description sets forth the functions and the sequence of steps for constructing and operating the evaporative cooling device in connection with the illustrated embodiments. However, it is to be understood that the same or equivalent functions and sequences may be accomplished by different embodiments that are also intended to be encompassed within the spirit and scope of the invention.

An evaporative cooling device 100 is introduced below. Herein, the evaporative cooling device 100 comprises a combination of insulative surfaces and evaporative surfaces. Herein, the evaporative surfaces facilitate the evaporation of a liquid and create cooling in the evaporative cooling device 100 while the insulative surfaces limit heat transfer in or out of the evaporative cooling device 100 from air, sunlight or ground. In one embodiment, the evaporative cooling device 100 may comprise at least 4 sides, wherein the top portion side and the bottom portion side comprise of the insulative surface and the right portion side or right wall and the left portion side or left wall comprise of evaporative walls. In further examples, the evaporative cooling device 100 may comprise of a shape with more or less than six sides, wherein all of the sides may comprise of evaporative surfaces. In an additional example, the sides may comprise of partially evaporative panels. It may be understood that the greater surface area of the evaporative surface, the greater the amount of cooling that can occur in the evaporative cooling device 100.

In one embodiment, the insulative surfaces may be made from a variety of insulating materials, including, but not limited to air bladders, insulative foams, metalized materials, insulative fabrics, or the like, or any combination thereof.

In an additional embodiment, each evaporative wall comprises multiple layers that form a sandwich of fabrics. The sandwich of fabrics may comprise an internal fabric layer and a membrane fabric layer. The internal fabric layer forms an inner liner of the evaporative cooling device 100 and may be substantially liquid impermeable. The membrane fabric layer, facing the outside of the evaporative cooling device 100, may be vapor permeable (e.g., water vapor permeable). In one embodiment, a space or void is created between the internal and membrane fabric layers. The space or void between the internal and membrane fabric layers may be filled with water or other liquid substance.

In a further embodiment, an additional layer of material may be added on top of the membrane fabric layer. This configuration may include an internal fabric layer of the evaporative cooling device 100 which may be substantially liquid impermeable, a membrane fabric layer facing the outside of the evaporative cooling device 100 which is vapor permeable, and a third layer of material capable of bonding with the inner liner to form an outermost layer of the sandwich of fabrics. One purpose of this additional external, third layer of material is to facilitate stronger permanent adhesion between the internal and membrane fabric layers of the sandwich of fabrics. This third layer of material may be produced in such a way that the vast majority of it is cut out, exposing the membrane fabric layer beneath it to the outside environment. This allows the membrane fabric layer improved possible access to the air facilitating evaporation. The residual material left on the third fabric layer may trace weld lines that connect and seal all three layers together (e.g., the internal, membrane, and third fabric layers) as well as additional connection which facilitate production. When the sandwich is bonded via plastics welding the outermost third fabric layer may melt through the membrane fabric layer and bonds to the inner fabric layer, pinning the sandwich in place providing enhanced strength as well as an additional reservoir of weld material to flow into the connection.

In a further embodiment, when in use, environmental energy in the form, of heat causes liquid contained within the space or void between the internal and membrane fabric layers to evaporate. In these instances, the vapor passes through the vapor permeable membrane fabric layer and is released into the outside environment. The exiting vapor takes energy away with it, which has the net effect of reducing the temperature of the evaporative cooling device 100 and creating a cool environment within an interior of the evaporative cooling device 100. In some examples, the layers in the sandwich of fabrics may be used to humidify and/or cool an interior of the evaporative cooling device 100. In an example, the sandwich of fabrics may include an exterior fabric layer that is substantially liquid impermeable, and an interior, membrane fabric layer that is vapor permeable, and the techniques described in may be used for humidifying an interior of the evaporative cooling device 100. In some examples, the sandwich of fabrics may include an inner fabric layer and an exterior fabric layer that are each vapor permeable, and the techniques described in may be used for humidifying and cooling an interior of the evaporative cooling device 100.

In one embodiment, a benefit of the design of the evaporative cooling device 100 is that very little fluid is lost due to dripping. The rate of pervaporation through the semipermeable membrane fabric layer is determined by the fabric's capacity to "breathe" as well as the atmospheric conditions in the surrounding environment at any given moment.

In yet another embodiment, the inner and membrane fabric layers may define a set of panels, and each panel may store liquid in the space between the inner and membrane fabric layers and edges of each sidewall. Where the two fabric layers meet may be sealed to prohibit liquid from dripping out. Examples of methods for sealing may include but are not limited to Radio Frequency ("RF") welding also High Frequency (HF) welding or Dielectric welding), glue or other adhesive method.

In a further embodiment, the inner and membrane fabric layers may be joined at various points to prevent the panels from holding excessive liquid and bulging. These connections also help to ensure a more evenly distribution of liquid throughout each panel. Methods for joining walls may include, but are not limited to: welding, adhesive attachment, or mechanical attachment. In further embodiments, layers may also be joined by any of these means to an intermediary material which is then joined to the opposing layer. This method may be used to create more complex internal geometries. The outer and inner fabric layers may be joined to each other in a variety of patterns including being connected by long linear seams, being spot welded in various points or any other arcs or shapes which allow fluid to circulate throughout the void between the two fabric layers.

In another embodiment handles are affixed to the bottom of the evaporative cooling device 100 allowing for easier movement and transportation when the evaporative cooling device 100 is fully assembled.

In yet another embodiment of the apparatus, the fill port may be affixed to the evaporative cooling device 100 when not in use to ensure that the fill port to the evaporative cooling device 100 does not obstruct the user in any way and ensures that liquid does not spill out of the fill port. Attachment methods may include, but are not limited to, the use of snaps, clasps and hook-and-loop fasteners.

It should be noted that storing water in the evaporative cooling device 100 instead of on a tray above has an added benefit of reducing the ability for insects, like mosquitoes, to colonize in the evaporative cooling device 100. This semipermeable fabric panel construction also has the advantage that it works even when the membrane fabric layer is saturated in dust meaning that it could prove a good solution for preserving foods while in transport on open trucks or environments with soil erosion and wind.

In yet another embodiment of the evaporative cooling device 100, the evaporative walls comprise of a sandwich of low ater permeable material on the inside and a material highly permeable to liquid water on the outside. In this embodiment, instead of just water stored in between the two fabrics, a quantity of fluid absorbent gel such as sodium polyacrylate, or polyacrylamide gel, or the like, is trapped between them. When the evaporative cooling device 100 is wetted, for example with water, the gel absorbs the fluid. Water is slowly released by the gel through the permeable wall over time. The gel may be treated with a protective agent to keep it from breaking down when exposed to light or water with high minerality. A fabric envelope may be used to hold the gel and may also be treated and colored to reduce the effects of prolonged sun exposure on the gel.

In yet another embodiment of the evaporative cooling device 100, individual evaporative panels and/or walls may be removable allowing the evaporative panels to be cleaned, replaced or recharged while not assembled on the evaporative cooling device 100.

In one embodiment, a top portion of the evaporative cooling device 100 may help limit the thermal exchange between the inside of the evaporative cooling device 100 and the outside environment. Further the top portion may be removable and/or open to allow access to the interior space of the evaporative cooling device 100. In a further embodiment, the top portion may also include a liquid tank which holds additional liquid for the evaporative panels.

In an additional variation, evaporative panels/walls of the evaporative cooling device 100 may be in communication and/or connected to each other. Wherein the evaporative panels are in communication with each other allows for an equalization of the contents inside the evaporative cooling device 100, as well as, for the added convenience for the user of being able to load all of the evaporative walls from a single port.

In another embodiment, the evaporative cooling device 100 is capable of folding up to reduce the volume it occupies during transport. This may be accomplished by removing plastic stays and/or foam components and then collapsing, rolling or crushing the remaining fabric body.

In a further embodiment, the evaporative cooling device 100 may be designed for attachment inside of a pre-existing rigid object such as a milk crate. The evaporative cooling device 100 may either attach to the top of the crate and hang or stand up inside. The external crate may provide additional structure and durability/protection for the evaporative cooling device 100 and its contents contained therein.

In yet another embodiment, the evaporative cooling device 100 may have permanent or removable dividing walls to organize its contents.

In another embodiment, a removable top, which allows access to the inside of the device, may be connected to a main body of the evaporative cooling device 100 permanently. The function allows the top to swing open. The top may be attached to the evaporative cooling device 100 by means of a sewn seam or hinge. Further, the top may be connected temporarily to the main body of the evaporative cooling device 100. Temporary attachment may occur by means of hook-and-loop fasteners or may be completely independent of the bottom. In one embodiment, the fill spout can also be used as a door hinge by means of a temporary attachment method such as a hook and loop fastener.

In an additional embodiment, the top may be designed to fully seal the evaporative cooling device 100. Sealing of the device may be accomplished by use of a zipper mechanism, hook and loop fastener mechanism around the entire lid, or may be made to be in close proximity to the main body without sealing to it.

In another embodiment, the evaporative cooling device 100 may have an internal caddy, which acts as shelving to protect the contents at the bottom from being crushed under the weight of those on top.

In another embodiment, the evaporative cooling device 100 may comprise of an inner liner, wherein the liner may be a fabric or semipermeable membrane. In this case the internal humidity of the evaporative cooling device 100 may be near or at 100%.

A further embodiment of the evaporative cooling device 100 includes that the overall shape may be trapezoidal. This shape serves several functions: first it increases the surface area of any side cooling walls and/or panels. Secondly, it allows any condensation forming on the inner liner of the unit to move to the floor without coming in contact with, and potentially affecting, the stored contents inside.

In an additional embodiment, the top and the bottom parts of the evaporative cooling device 100 may interlock when collapsed to facilitate ease of transport when not in use. This can be accomplished though specially made extensions or recesses in the frame or by molding such connectors in the top or bottom sections of the evaporative cooling device 100.

In another embodiment, the evaporative cooling device 100 may have a removable inner liner which is designed to facilitate easy cleaning and create a barrier between the contents stored therein and the more permanent structures of the evaporative cooling device 100. Such a liner may trap and prevent water and other biological continents from coming in contact with the sides or bottom of the evaporative cooling device 100 and is designed to be easily removed and cleaned.

In another embodiment, the top and bottom of the evaporative cooling device 100 may have an external protective shell. This shell is intended to function similarly to a bicycle helmet and to shield the evaporative cooling device 100 from external mechanical stresses.

In another embodiment, a transparent window can be added to the evaporative cooling device 100 in order to facilitate easy viewing of contents within the evaporative cooling device 100. This may be accomplished through the use of translucent glasses, plastics, insulated or coated materials.

In yet another embodiment, the evaporative cooling device 100 may have indentations in its top and base so that the evaporative cooling device 100*s* may be stacked above or below other evaporative cooling devices 100. This feature is helpful for storing a number of the evaporative cooling devices in a confined space either while they are stationary (for example in a warehouse) or when they are in use in transport (such as on the back of a truck).

Referring now to the figures to illustrate an embodiment, FIG. 1 illustrates an outside perspective view of the evaporative cooling device 100, wherein a top portion 11 of the evaporative cooling device 100 is assembled on top of the evaporative cooling device 100. As shown, the exterior of the evaporative cooling device 100 comprises of at least one wall portion 2. Herein, the evaporative cooling device 100 comprises of a pair of opposing walls and the walls are attached to create a housing. Herein, a bottom panel 12 is in communication with the pair of opposing walls that create the housing. Further, as shown, a top cover portion 11 is attached to the top of the evaporative cooling device 100.

A door 13 is built into the top portion 11 of the evaporative cooling device 100, which allows for access into the internal compartment without removing the entire top portion, 11. A handle, 14 is attached to door 13 which facilitates the opening of the door.

In at least one wall portion, there is at least one cooling panel 1. As further explained below, liquid travels with gravity from the fill port 7, into the inner wall of the cooling panels 1. In FIG. 1, two evaporative walls 2 of the evaporative cooling device 100 are shown. Each evaporative wall 2 includes two rows of cooling panels 1, where each of the cooling panels 1 is formed between an inner fabric layer 5 and a membrane fabric layer. Each evaporative wall 2 may include a single row of cooling panels, or any desired number of cooling panels 1. When the liquid flows into the cooling panels 1, the liquid passes through a network of diversions 4, which are created from areas where the internal and membrane fabric layers of the cooling panel 1 are bonded together. These diversion 4 help control the flow of liquid and act to keep the internal and membrane fabric layers of the cooling panels 1 from billowing out away from each other. This, in turn, controls the amount of liquid in a panel 1 at any one time which reduces the stress on the seams connecting the internal and membrane fabric layers and helps maintain a substantially even maximum distance of separation between the internal and membrane fabric layers throughout the cooling panel 1.

Figure 2:
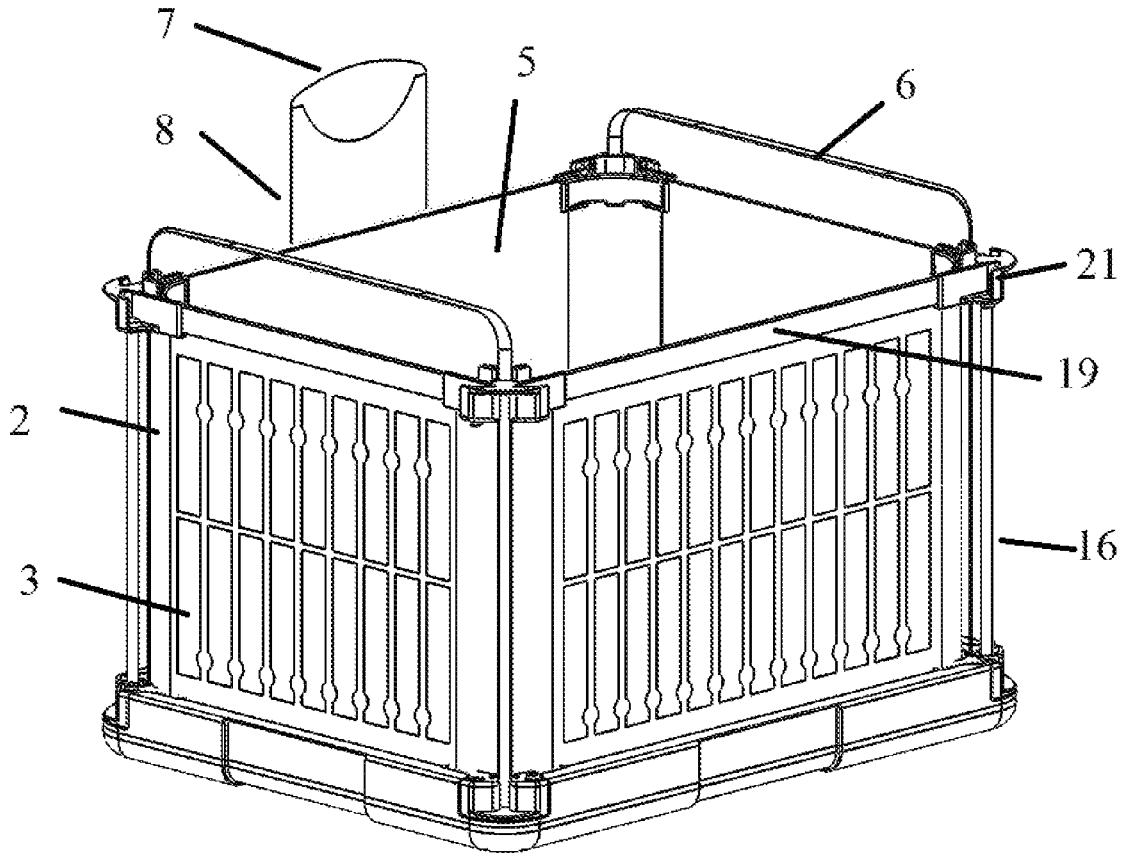
FIG. 2 illustrates an outside perspective view of one embodiment of the evaporative cooling device with the top cover portion and door removed and a fill port retracted.

Now referring to FIG. 2, the figure shows an outside perspective view of the evaporative cooling device 100, wherein the top cover 11 and door 13 are removed. The inside structures of the evaporative cooling device 100 are visible. The top portion of the evaporative cooling device 100 is able to stay upright and to shape because of a top support member 19. Herein, the opposing walls 2 comprise of the inner fabric layer 5. As discussed above, the inner fabric layer 5 forms an inner liner of the evaporative cooling device 100 and may be substantially water impermeable. The walls 2 are held in tension by the use of removable stays 16 and thus, with this stays 16 structure, the evaporative cooling device 100 is able to stay upright in an uncollapsed state. Removing the stays 16 permits the evaporative cooling device 100 to be contracted into a collapse state.

Figure 3:
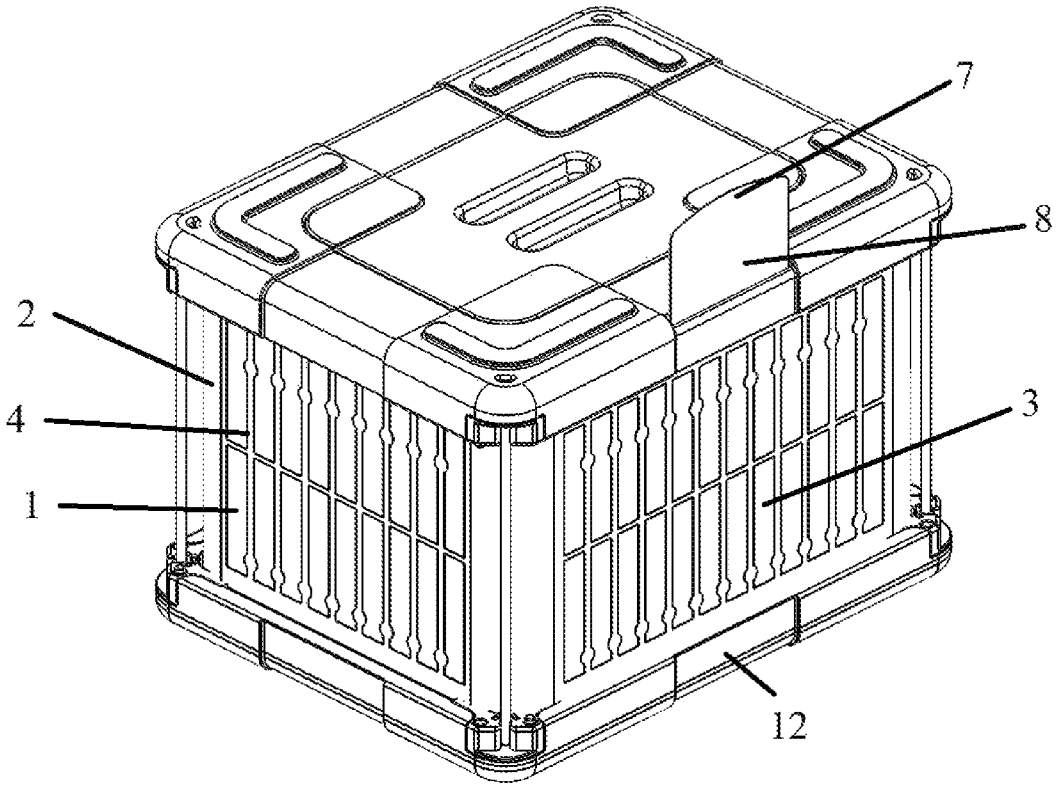
FIG. 3 illustrates an outside perspective view of one embodiment of the evaporative cooling device with the fill port extended.

FIG. 3 illustrates an outside perspective of the evaporative cooling device 100 with the fill port 7 extended. In this embodiment, to make the evaporative cooling device 100 cool, liquid may first be loaded into a fill port 7. To accomplish this, the port 7 may be pulled away from the top cover portion 11. Once free, the sides of the port 7 may then be lightly pushed towards each other. This will cause the two pieces of fabric which form the port 7 to separate allowing liquid to be poured in. The user fills the evaporative cooling device 100 up to a designated fill line (not shown). Once the user has completed filling the evaporative cooling device 100, the fill port 7 is released and returned to its original closed position.

Upon entering the mouth of the fill port 7, liquid passes down the neck of the port 8. A removable filter (not shown) can be laced in the neck to limit the particulate that can enter the device 100 when using untreated water as the evaporative liquid. Liquid travels with gravity through the network of diversions 4 and into the space between the cooling panels 1 and the inner fabric 5. The diversions 4 are created from areas where the inner fabric layer and the membrane fabric layer of the cooling panel 1 are bonded together. These diversions help control the flow of liquid and act to keep the walls of the cooling panels 1 from billowing out away from each other. This, in turn, controls the amount of liquid in the panel 1 at any one time which reduces the stress on the seams and helps maintain a substantially even maximum distance of separation between the inner fabric layer and the membrane fabric layer throughout the cooling panel 1.

Figure 4:
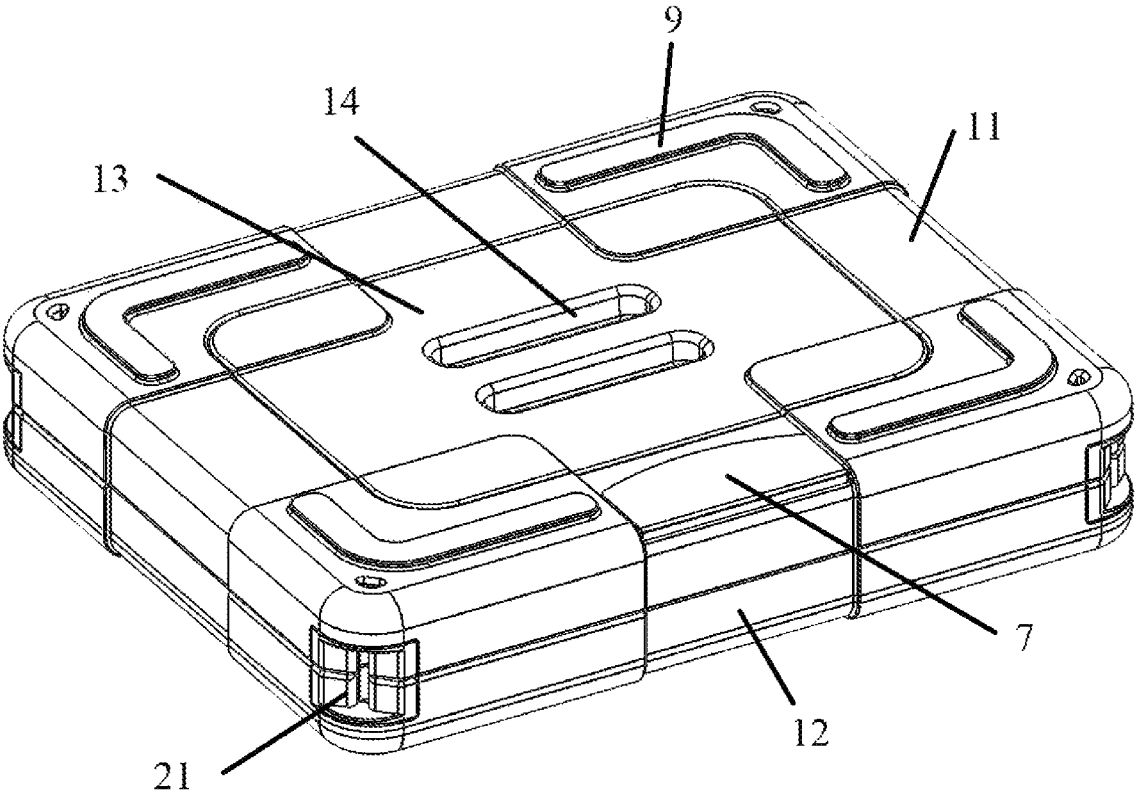
FIG. 4 illustrates an outside perspective view of one embodiment of the evaporative cooling device in its collapsed state.

FIG. 4 shows one embodiment of the design in a flattened state for ease of transport. The evaporative cooling device 100 may be assembled in a reduced, or minimum, number of steps. To deploy the evaporative cooling device 100 from a collapsed state to an uncollapsed state, the top 11 and bottom 12 may be pulled away from each other. This stretches the evaporative walls 2 into position. Stays 16 are slid into respective slots 22 in each corner 21. In some examples, stay 16 may be held in place with a molded feature in corner 21, or by tension from the materials which comprise the evaporative walls 2.

In an additional embodiment the top 11 of the evaporative cooling device 100 can possess ridges 9 and slots 10 which facilitate the secure stacking of the evaporative cooling device 100 above or below other evaporative cooling devices 100. The ridge 9 on the top 11 may fit into the slot 10 in the bottom 12 of the evaporative cooling device 100 sitting on top of it. Such stacking can be beneficial for storing evaporative cooling devices vertically and can be used when the evaporative cooling device 100 is in both open and closed states. Because the cooling panels 1 may be recessed from the side edges of the evaporative cooling device 100, there may be airflow across the evaporative walls 2 to facilitate evaporation even when columns of stacked evaporative cooling devices are placed next to each other. Fill port 7 can be pulled to the fill position prior to stacking which allows the evaporative cooling device 100 to be refilled with liquid without the need to unstack the evaporative cooling devices.

In an example, an external wall of the cooling panel 1 may be made from a laminated material 3. The external portion of this material 3 is comprised of a protective fabric. The internal fabric layer is a semi-permeable membrane that is porous to water vapor but not liquid water. Water stored in the cooling panel 1 evaporates through an outer, membrane fabric layer in conditions where there is less than 100% ambient humidity. As it does this, the exiting vapor pulls heat energy out, and cooling an interior, of the evaporative cooling device 100. All of the internal contents will thereby be cooled below ambient outside temperature.

As liquid evaporates through cooling panel 1 the volume of liquid decreases in the space between the internal and membrane fabric layers. This system is highly efficient in that liquid is not allowed to drip out—the only way it can exit is evaporation through the membrane fabric layer. The flexibility of the internal and membrane fabric layers and the open nature of the fill port 7 also beneficially keep a vacuum effect from building up inside of the cooling panel 1. In some examples, the membrane fabric layer 202 may have pores that are sufficiently small such that liquid only passes through via evaporation, thereby, in some examples, efficiently using liquid added to the evaporative cooling device 100. In some examples, the membrane fabric layer may have pores that are sufficiently small to prevent liquid dripping.

Figure 5:
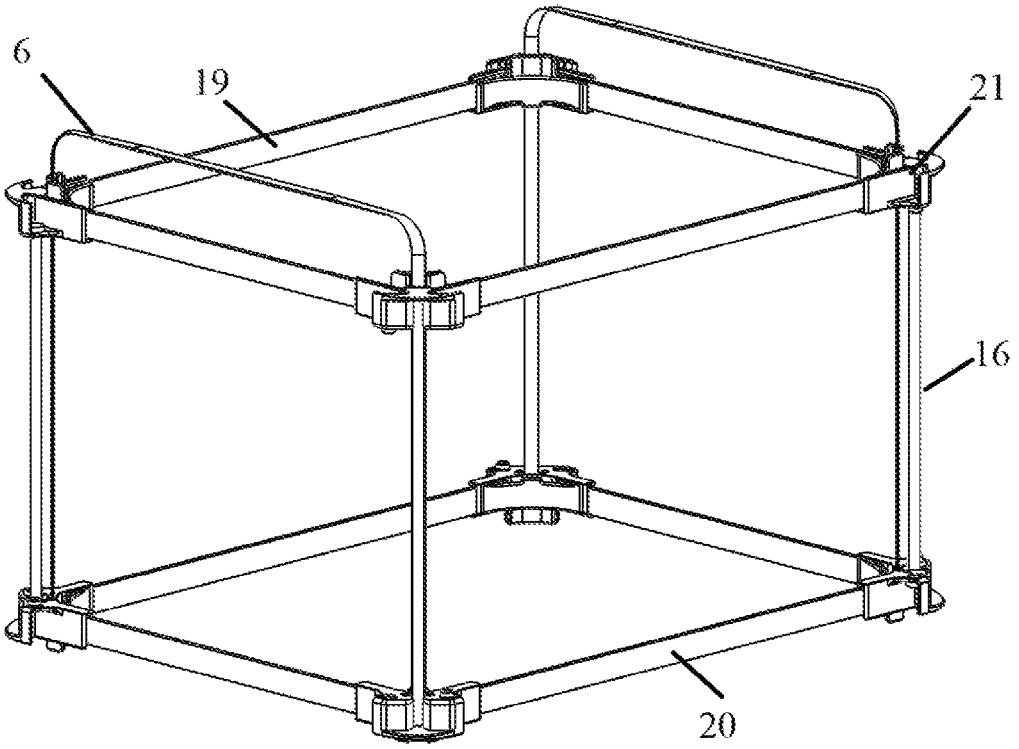
FIG. 5 illustrates a perspective view of one embodiment of the evaporative cooling device of the internal skeleton of the evaporative cooling device showing four vertical stays as well as four top supports and four bottom supports.

FIG. 5 illustrates a perspective view of the evaporative cooling device 100 wherein the internal skeleton of the device 100 is apparent. The internal skeleton of the evaporative cooling device 100 may comprise at least four vertical stays 16, at least four top supports 19, at least four bottom supports, 20. The top four supports 19 further comprise at least one corner 21 and the bottom supports further comprise at least corner 21.

Figure 6:
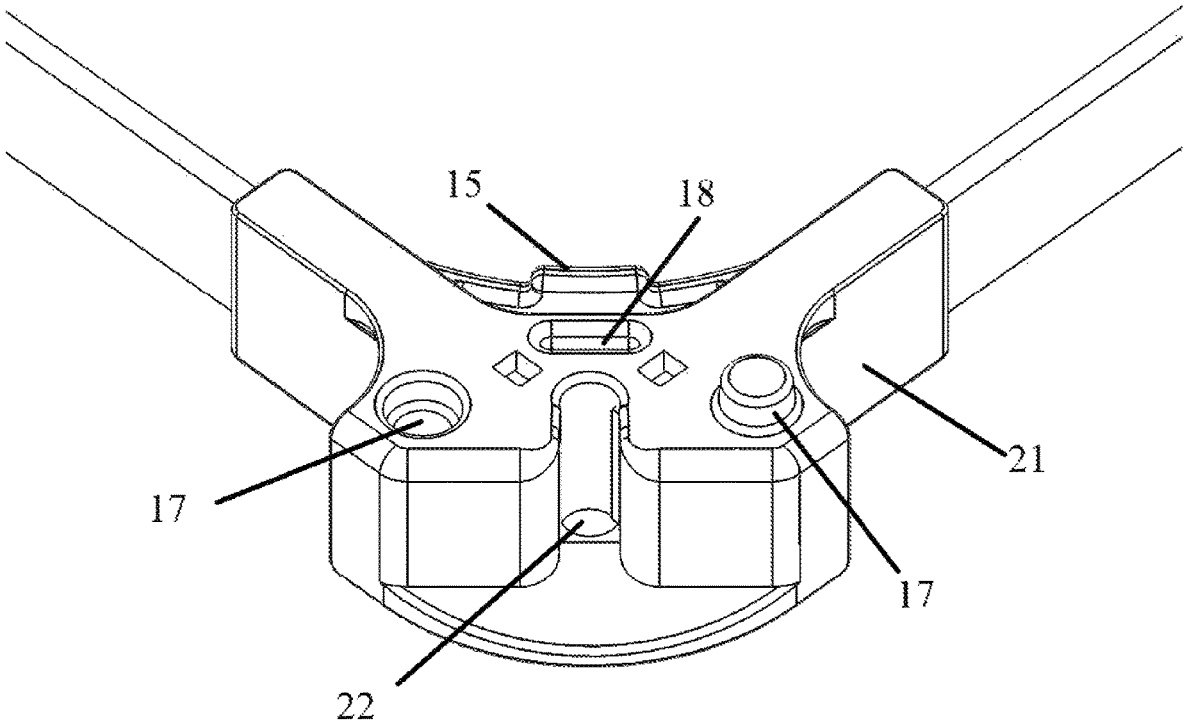
FIG. 6 illustrates a magnified perspective view of one corner of the internal support skeleton of the evaporative cooling device and its representative features.

FIG. 6 illustrates a perspective view of one corner 21 with two top supports 19. Slot 22 holds stay 16 when the evaporative cooling device 100 is in its deployed, uncollapsed, configuration. Registration features 17 may be used to keep the evaporative cooling device 100 tightly together in its non-deployed, compacted travel, collapsed state. Pass through 18 allows for a carry strap 6 or handle to pass through the corner piece. The carry strap 6 is designed to anchor into the bottom of the evaporative cooling device 100 to provide maximum security and support during transport. Anchor point 15 is used anchor the corners of the walls to the internal frame of the evaporative cooling device 100.

Figure 7:
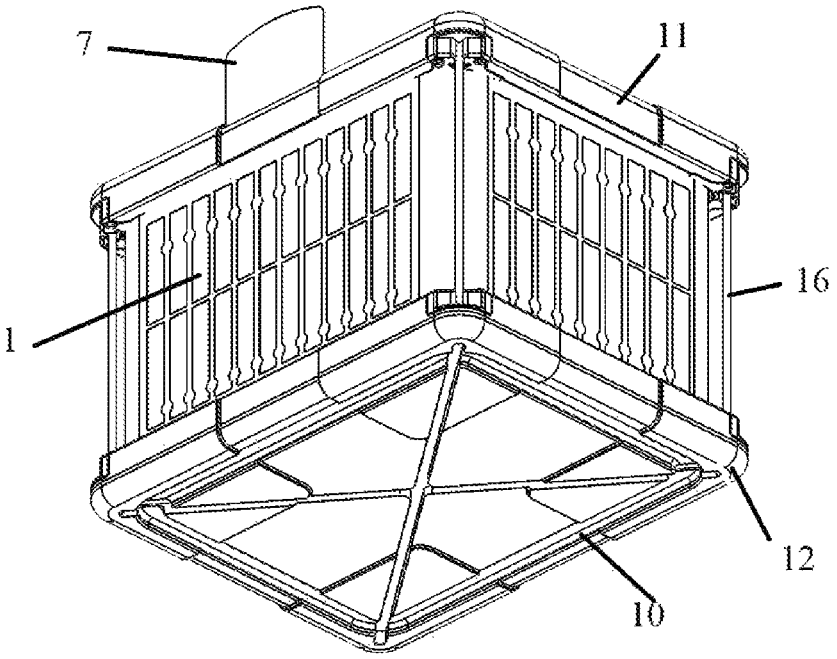
FIG. 7 illustrates a perspective views of the bottom of one iteration of the evaporative cooling device.

FIG. 7 illustrates a perspective view of a bottom of the evaporative cooling device 100. Slots 10 designed for the stacking of evaporative cooling device 100*s* are shown.

Figure 8:
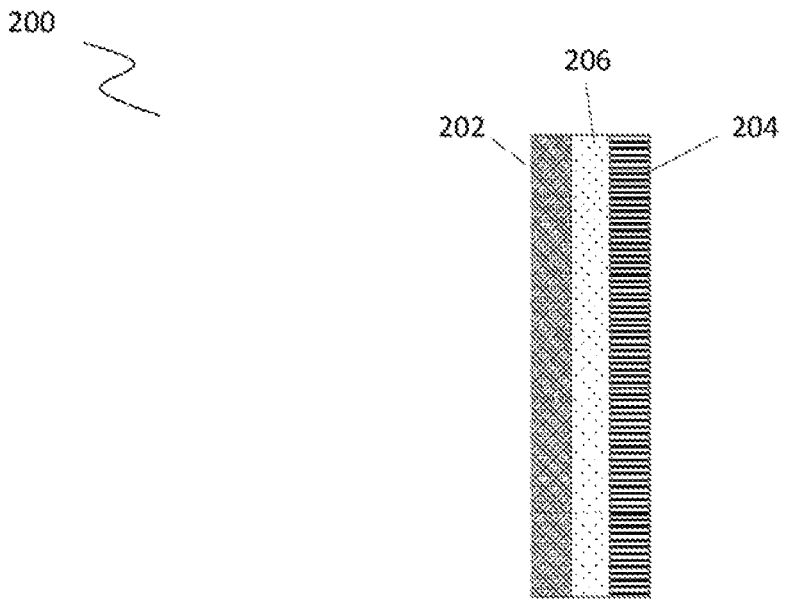
FIG. 8 illustrates a cross-sectional rendering of the evaporative wall, identifying the layers, or sandwich of materials present within an individual evaporative wall; and, FIG. 9 illustrates a cutaway, cross-sectional side view of the evaporative wall illustrating the sandwich combination of fabrics, the network of liquid diversions and the bonded areas therein.

In a further example, FIG. 8 illustrates a cutaway side view of the evaporative wall 200 which may include a sandwich of fabrics (herein the network of diversions 4 are not shown in order to clearly illustrate the sandwich of fabrics). Evaporative wall 200 is an example of evaporative wall 2 described above. The sandwich of fabrics may comprise an internal fabric layer 204 and membrane fabric layer 202. The internal fabric layer 204 forms the inner liner of the evaporative cooling device 100 and may be substantially liquid impermeable. The membrane fabric layer 202 may be an external layer facing the outside of the evaporative cooling device 100, and may be vapor permeable. The internal fabric layer 204 and the membrane fabric layer 202 may together form the cooling panel 1. In one embodiment, a void layer 206 is created between the internal fabric layer 204 and the membrane fabric layer 202. The void layer 206 between the two layers 202, 204 may be an opening that may be filled with and contain water or other liquid therein. Further, the void layer 206 may be filled with fluid absorbent gel, such as sodium polyacrylate, or polyacrylamide gel, or the like. Moreover, in another example, the void layer 206 between the internal fabric layer 204 and the membrane fabric layer 202 may be filled with other liquid substances in varying states of matter. Through evaporation, vapor may pass through the vapor permeable membrane fabric layer 202 and be released into the outside environment. The exiting vapor takes energy away with it, which has the net effect of reducing the temperature of the evaporative cooling device 100 and cooling an interior of the evaporative cooling device 100.

In some examples, the order of the layers in the sandwich of fabrics may be reversed to humidify an interior of the evaporative cooling device 100. For example, the exterior fabric layer may be substantially liquid impermeable (e.g., water impermeable), and an interior fabric layer may be a membrane fabric layer that is vapor permeable. Evaporation through the interior, membrane fabric layer may humidify an interior of the evaporative cooling device 100. In other examples, the sandwich of fabrics may include an inner fabric layer and an exterior fabric layer that are each vapor permeable. Evaporation through the interior and exterior fabric layers may humidify and cool an interior of the evaporative cooling device 100.

Figure 9:
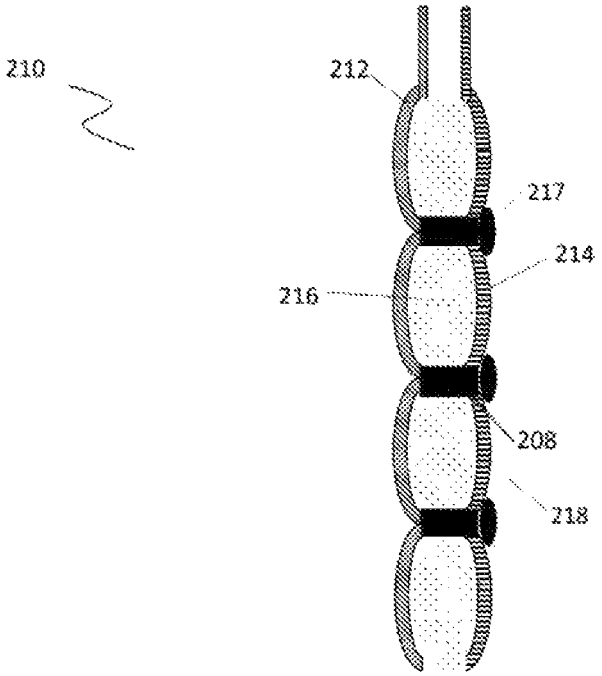

In a further example FIG. 9 illustrates a cutaway side view of the evaporative wall 210 which in at least one embodiment comprises a sandwich of fabrics. Evaporative wall 210 is an example of evaporative wall 2 described above. The sandwich of fabrics may comprise an internal fabric layer 212, membrane fabric layer 214, and a top fabric layer 217. The internal fabric layer 212 forms the inner liner of the evaporative cooling device 100 and may be substantially liquid impermeable. The member fabric layer 214 may face the outside of the evaporative cooling device 100, and may be vapor permeable. The top fabric layer 217 may be in contact with the membrane fabric layer 214 and may help bind the internal fabric layer 212 to the membrane fabric layer 214.

In one example, a void layer 216 may be created between the internal fabric layer 212 and the, membrane fabric layer 214. The void layer 216 between the internal fabric layer 212 and the membrane fabric layer 214 may be filled with water or other liquid. The internal fabric layer 204 and the membrane fabric layer 202 may together form a pouch to contain the liquid within the void layer 204. Further, the void layer 216 may also be filled with fluid absorbent gel, such as sodium polyacrylate, or polyacrylamide gel, or the like. Moreover, in another embodiment, the void layer 216 between the internal fabric layer 212 and the membrane fabric layer 214 may be filled with other liquid substances in varying states of matter.

One embodiment of the network of diversions 4 are illustrated which are created from areas where the membrane fabric layer 214 and the interior fabric layer 212 of the cooling panel 1 are bonded together at 208, creating a pillowing effect on the membrane fabric layer 214 and the interior fabric layer 212. In one example the top fabric layer 217 may situated over the points where the membrane fabric layer 214 and the interior fabric layer 212 are bonded together at 208. In some examples, the top fabric layer may highly perforated and vapor permeable. The areas where material has been removed create a window 218 where the membrane fabric layer 214 is in direct contact with the outside air facilitating evaporation and cooling. As described above, evaporation through the membrane fabric layer 214 may cool an interior of the evaporative cooling device 100. Also described above, the order of the layers in the sandwich of fabrics may be changed to humidify an interior of the evaporative cooling device 100, or the interior and exterior fabric layers may each be vapor permeable to both cool and humidify an interior of the evaporative cooling device 100.

It should be understood that various alternatives to the embodiments of the disclosure described herein may be employed in practicing the disclosure. Elements of an implementation of the systems and methods described herein may be independently implemented or combined with other implementations. It is intended that the claims to follow with the utility application define the scope of the disclosure and that systems, methods, and devices within the scope of these claims and their equivalents be covered thereby.

What is claimed is:

1. An evaporative cooling device comprising:

a housing comprising:

a top cover portion; and a plurality of walls, wherein at least one of the walls comprises:

an evaporative wall comprising a sandwich of fabrics that comprises an internal fabric layer, a membrane fabric layer, and a top fabric layer that binds the internal fabric layer to the membrane fabric layer, the evaporative cooling device being deployable between a collapsed state and an uncollapsed state.

2. The evaporative cooling device of claim 1, further comprising:

a bottom portion, wherein the plurality of walls comprises at least two opposing walls extending from the bottom portion; and a door for accessing an interior of the evaporative cooling device.

3. The evaporative cooling device of claim 1, wherein the evaporative wall comprises evaporative materials to facilitate evaporation and to cool an interior of the housing.

4. The evaporative cooling device of claim 1, wherein the internal fabric layer forms an inner lining of the evaporative cooling device.

5. The evaporative cooling device of claim 1, wherein the membrane fabric layer forms an outer surface of the evaporative cooling device.

6. The evaporative cooling device of claim 1, wherein the top fabric layer comprises a perforated external fabric layer that is configured to bind the internal fabric layer the membrane fabric layer.

7. The evaporative cooling device of claim 6, wherein the perforated external fabric layer is a vapor permeable material.

8. The evaporative cooling device of claim 1, wherein the top cover portion comprises an insulative surface that limits the transfer of heat in or out of the evaporative cooling device.

9. The evaporative cooling device of claim 1, wherein at least one of the plurality of walls is removable.

10. A method of utilizing an evaporative cooling device, comprising:

assembling the evaporative cooling device from a collapsed state to an uncollapsed state;

activating a fill port;

filling the fill port with a liquid until at least one wall is filled, the at least one wall comprising a sandwich of fabrics in which the liquid is received, the sandwich of fabrics comprising an internal fabric layer, a membrane fabric layer, and a top fabric layer that binds the internal fabric layer to the membrane fabric layer;

and, securing a top cover portion to the evaporative cooling device.

* * * * *